US006345861B1

(12) United States Patent
Goodo

(10) Patent No.: US 6,345,861 B1
(45) Date of Patent: Feb. 12, 2002

(54) COMPACT TRANSPORTABLE FOLDING CHAIR

(76) Inventor: William Goodo, 100 Ninth St. #501, Oakland, CA (US) 94607

( * ) Notice: Subject to any disclaimer, the term of this patent is extended or adjusted under 35 U.S.C. 154(b) by 0 days.

(21) Appl. No.: 09/649,884

(22) Filed: Aug. 28, 2000

(51) Int. Cl.[7] ..... A47C 4/00

(52) U.S. Cl. ..... 297/53; 297/171; 297/188.05; 297/188.06; 297/452.2

(58) Field of Search ..... 297/53, 54, 188.05, 297/188.06, 188.04, 452.2, 170, 171, 452.18; 224/275

(56) References Cited

U.S. PATENT DOCUMENTS 1,231,386 A * 6/1917 Kuczabowski
1,426,140 A * 8/1922 Anselm
1,493,467 A * 5/1924 Butt et al.
1,531,837 A * 3/1925 Boldin
1,788,832 A * 1/1931 Hamburg
2,267,861 A * 12/1941 Haley
2,984,294 A * 5/1961 Epstean
5,865,124 A * 2/1999 Wroe

* cited by examiner

*Primary Examiner*—Milton Nelson, Jr.
(74) *Attorney, Agent, or Firm*—Goldstein Law Offices, P.C

(57) ABSTRACT

A compact transportable folding chair including a seat portion comprised of a horizontal support. The horizontal support includes a forward tubular support and a rearward tubular support in a spaced relationship. The horizontal support includes a central support portion secured between the forward and rearward tubular supports. The central support portion has a padded cushion secured thereto. The central support has opposed side edges. The seat portion has opposed pairs of legs pivotally coupled thereto. A backrest portion is pivotally coupled with the seat portion. A pair of carrying straps are coupled with respect to the backrest portion. A support tray is removably coupled with the backrest portion.

7 Claims, 2 Drawing Sheets

COMPACT TRANSPORTABLE FOLDING CHAIR

BACKGROUND OF THE INVENTION

The present invention relates to a compact transportable folding chair and more particularly pertains to allowing a person to easily carry a chair on their back to provide seating at a distant location.

The use of folding chairs is known in the prior art. More specifically, folding chairs heretofore devised and utilized for the purpose of providing a seat that folds up for easy storage and transport are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a compact transportable folding chair for allowing a person to easily carry a chair on their back to provide seating at a distant location.

In this respect, the compact transportable folding chair according to the present invention substantially departs from the conventional concepts and designs of the prior art, and in doing so provides an apparatus primarily developed for the purpose of allowing a person to easily carry a chair on their back to provide seating at a distant location.

Therefore, it can be appreciated that there exists a continuing need for a new and improved compact transportable folding chair which can be used for allowing a person to easily carry a chair on their back to provide seating at a distant location. In this regard, the present invention substantially fulfills this need.

SUMMARY OF THE INVENTION

In the view of the foregoing disadvantages inherent in the known types of folding chairs now present in the prior art, the present invention provides an improved compact transportable folding chair. As such, the general purpose of the present invention, which will be described subsequently in greater detail, is to provide a new and improved compact transportable folding chair which has all the advantages of the prior art and none of the disadvantages.

To attain this, the present invention essentially comprises a seat portion comprised of a horizontal support. The horizontal support includes a forward tubular support and a rearward tubular support in a spaced relationship. The horizontal support includes a central support portion secured between the forward and rearward tubular supports. The central support portion has a padded cushion secured thereto. The central support has opposed side edges. The opposed side edges each have a side tab extending downwardly therefrom. The seat portion has opposed pairs of legs pivotally coupled thereto. The opposed pairs of legs each include a front leg and a rear leg. The front legs have an upper end pivotally coupled with the forward tubular support. The rear legs have an upper end pivotally coupled with the rearward tubular support. The front legs and the rear legs each have a lower end for supporting the seat portion when in an extended position. Each leg has a pivot brace pivotally coupled thereto. Each pivot brace has a free outer end pivotally coupled with a respective side tab of the central support. A backrest portion is pivotally coupled with the seat portion. The backrest portion includes a pair of side supports. The side supports have lower ends pivotally coupled with the rearward tubular support of the horizontal support of the seat portion. One of the side supports has an aperture formed therein. The pair of side supports have a fabric back support secured therebetween. The fabric back support has an upper edge and a lower edge. A pair of carrying straps are coupled with respect to the backrest portion. The carrying straps each have an upper end secured to the upper edge of the fabric back support and a lower edge secured to the lower edge of the fabric back support in a spaced relationship. A support tray is removably coupled with the backrest portion. The support tray has a vertical support member extending downwardly therefrom. The support tray includes a horizontal support member having a support collar extending upwardly therefrom. The support collar has an open upper end for rotatably receiving the vertical support member therein. The horizontal support member has an inner end removably received within the aperture of the side support of the backrest portion. The support tray includes a cup holding block secured to the horizontal support member. The cup holding block has a cup receiving recess formed therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved compact transportable folding chair which has all the advantages of the prior art folding chairs and none of the disadvantages.

It is another object of the present invention to provide a new and improved compact transportable folding chair which may be easily and efficiently manufactured and marketed.

It is a further object of the present invention to provide a new and improved compact transportable folding chair which is of durable and reliable construction.

An even further object of the present invention is to provide a new and improved compact transportable folding chair which is susceptible of a low cost of manufacture with regard to both materials and labor, and which accordingly is then susceptible of low prices of sale to the consuming public, thereby making such a compact transportable folding chair economically available to the buying public.

Even still another object of the present invention is to provide a new and improved compact transportable folding chair for allowing a person to easily carry a chair on their back to provide seating at a distant location.

Lastly, it is an object of the present invention to provide a new and improved compact transportable folding chair including a seat portion comprised of a horizontal support. The horizontal support includes a forward tubular support and a rearward tubular support in a spaced relationship. The horizontal support includes a central support portion secured between the forward and rearward tubular supports. The central support portion has a padded cushion secured thereto. The central support has opposed side edges. The seat portion has opposed pairs of legs pivotally coupled thereto. A backrest portion is pivotally coupled with the seat portion. A pair of carrying straps are coupled with respect to the backrest portion. A support tray is removably coupled with the backrest portion. These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
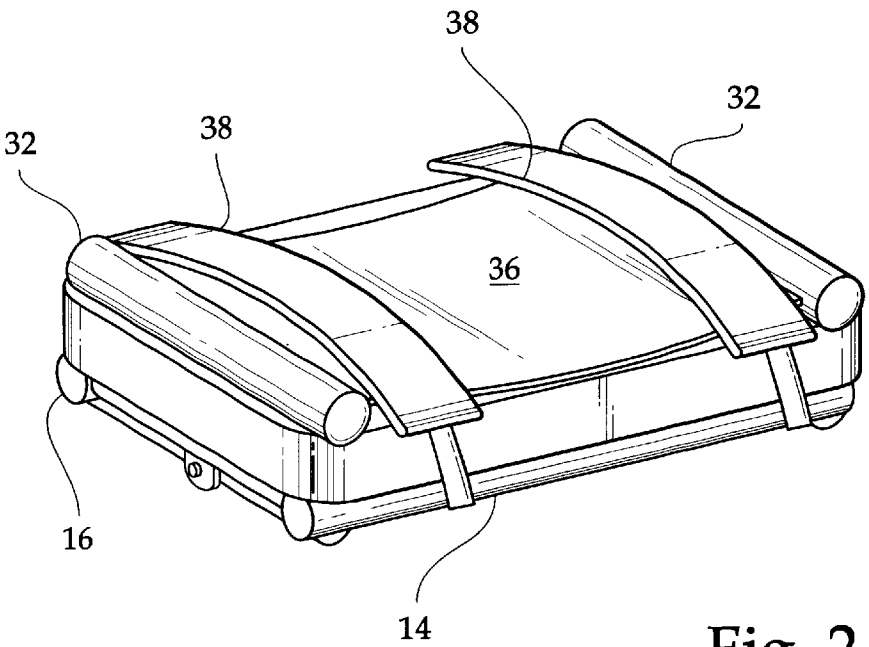
FIG. 2 is a perspective view of the present invention illustrated in a folded orientation.
Figure 1:
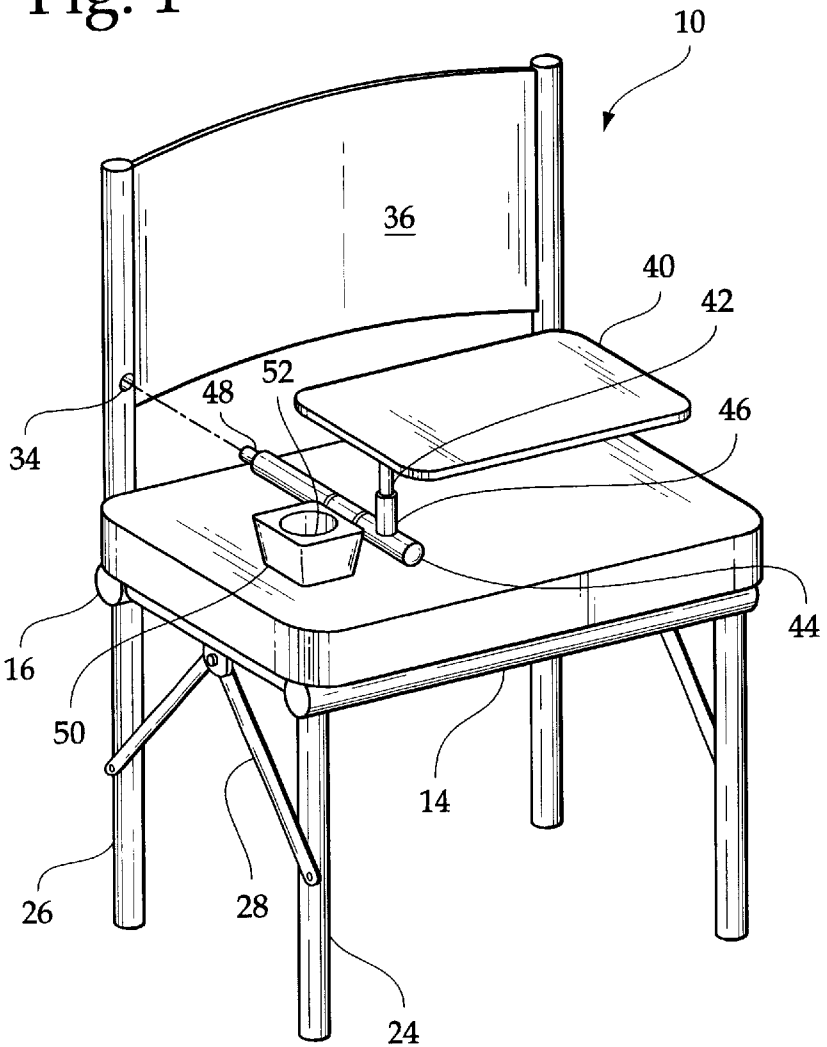
FIG. 1 is a perspective view of the preferred embodiment of the compact transportable folding chair constructed in accordance with the principles of the present invention.
Figure 3:
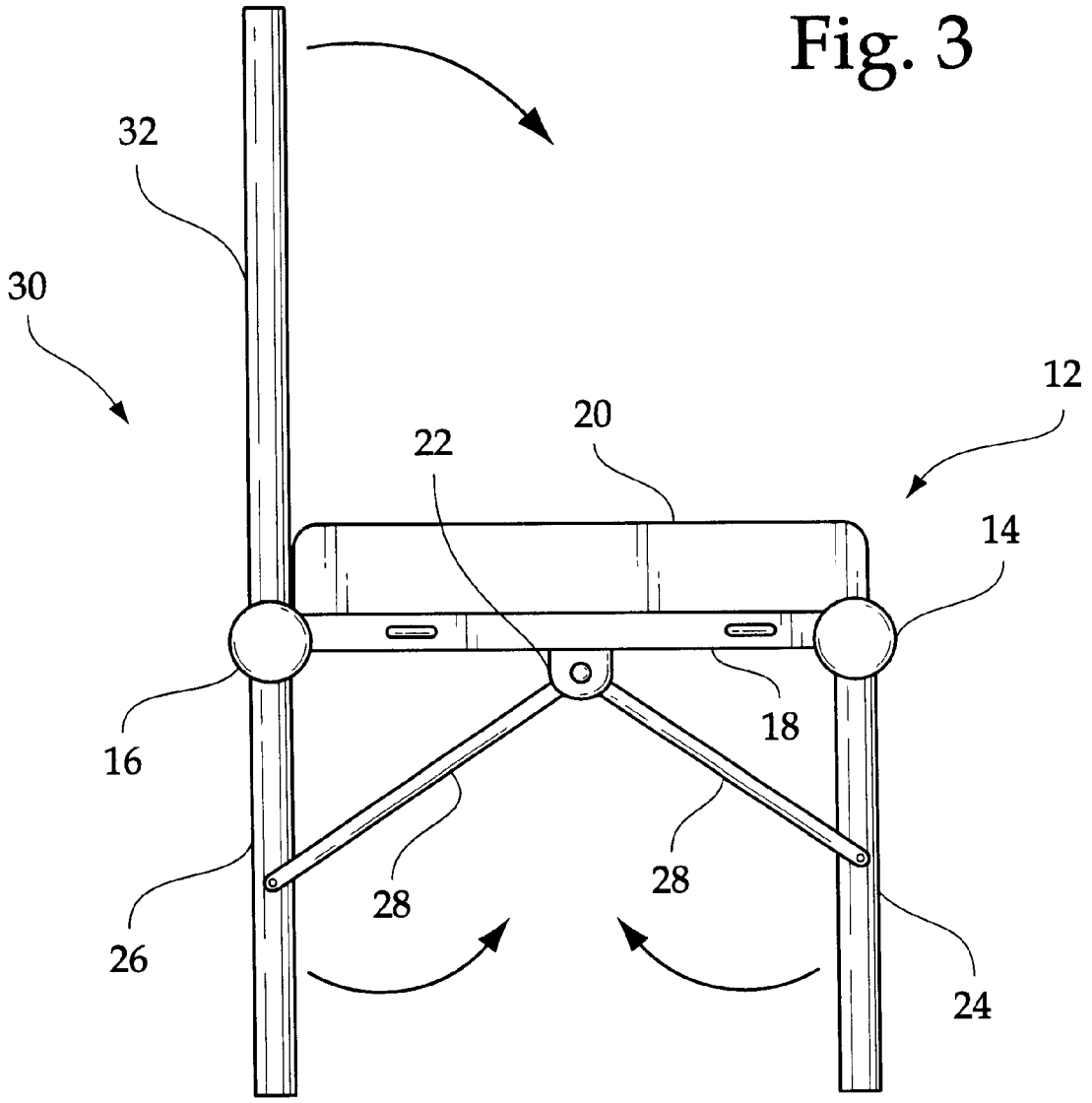
FIG. 3 is a side elevation view of the present invention.

With reference now to the drawings, and in particular, to FIGS. 1 through 3 thereof, the preferred embodiment of the new and improved compact transportable folding chair embodying the principles and concepts of the present invention and generally designated by the reference number 10 will be described.

Specifically, it will be noted in the various figures that the device relates to a compact transportable folding chair for allowing a person to easily carry a chair on their back to provide seating at a distant location. In its broadest context, the device consists of a seat portion, a backrest portion, a pair of carrying straps, and a support tray. Such components are individually configured and correlated with respect to each other so as to attain the desired objective.

The seat portion 12 is comprised of a horizontal support. The horizontal support includes a forward tubular support 14 and a rearward tubular support 16 in a spaced relationship. The horizontal support includes a central support portion 18 secured between the forward and rearward tubular supports 14,16. The central support portion 18 has a padded cushion 20 secured thereto. The central support portion 18 has opposed side edges. The opposed side edges each have a side tab 22 extending downwardly therefrom. The seat portion 12 has opposed pairs of legs pivotally coupled thereto. The opposed pairs of legs each include a front leg 24 and a rear leg 26. The front legs 24 have an upper end pivotally coupled with the forward tubular support 14. The rear legs 26 have an upper end pivotally coupled with the rearward tubular support 16. The front legs 24 and the rear legs 26 each have a lower end for supporting the seat portion 12 when in an extended position. Note FIGS. 1 and 3. Each leg 24,26 has a pivot brace 28 pivotally coupled thereto. Each pivot brace 28 has a free outer end pivotally coupled with a respective side tab 22 of the central support portion 18.

The backrest portion 30 is pivotally coupled with the seat portion 12. The backrest portion 30 includes a pair of side supports 32. The side supports 32 have lower ends pivotally coupled with the rearward tubular support 16 of the horizontal support of the seat portion 12. One of the side supports 32 has an aperture 34 formed therein. An aperture can be positioned on each of the side supports 32 in an alternate embodiment. The pair of side supports 32 have a fabric back support 36 secured therebetween. The fabric back support 36 has an upper edge and a lower edge.

The pair of carrying straps 38 are coupled with respect to the backrest portion 30. The carrying straps 38 each have an upper end secured to the upper edge of the fabric back support 36 and a lower edge secured to the lower edge of the fabric back support 36 in a spaced relationship. The carrying straps 38 will allow the device 10 to be carried in a manner similar to a back pack.

The support tray 40 is removably coupled with the backrest portion 30. Note FIG. 1. The support tray 40 has a vertical support member 42 extending downwardly therefrom. The support tray 40 includes a horizontal support member 44 having a support collar 46 extending upwardly therefrom. The support collar 46 has an open upper end for rotatably receiving the vertical support member 42 therein. The horizontal support member 44 has an inner end 48 removably received within the aperture 34 of the side support 32 of the backrest portion 30. The support tray 40 includes a cup holding block 50 secured to the horizontal support member 44. The cup holding block 50 has a cup receiving recess 52 formed therein.

In use, the device 10 can be folded outwardly whereby the legs 24,26 are in an extended position to allow a user to sit on the padded cushion 22 of the central support portion 18. Note FIG. 1. The backrest portion 30 is also pivoted upwardly to a vertical position to allow the seated person to comfortably lean back and be provided with back support. The user can secure the support tray 40 to the backrest portion 30 to allow them to eat their lunch and hold their beverage, or provide another use, such as support a book or the like. The user can fold the device 10 up, as noted in FIG. 2, for easy transport. The user simply removes the support tray 40, then folds the backrest portion 30 down atop the seat portion 12, and then folds the legs 24, 26 against the central support portion 18. The user can then use the carrying straps 38 to support the device 10 on their back for carrying.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A compact transportable folding chair for allowing a person to easily carry a chair on their back to provide seating at a distant location comprising, in combination:

a seat portion comprised of a horizontal support, the horizontal support including a forward tubular support and a rearward tubular support in a spaced relationship, the horizontal support including a central support portion secured between the forward and rearward tubular supports, the central support portion having a padded cushion secured thereto, the central support portion having opposed side edges, the opposed side edges each having a side tab extending downwardly therefrom, the seat portion having opposed pairs of legs pivotally coupled thereto, the opposed pairs of legs each including a front leg and a rear leg, the front legs having an upper end pivotally coupled with the forward tubular support, the rear legs having an upper end pivotally coupled with the rearward tubular support, the front legs and the rear legs each having a lower end for supporting the seat portion when in an extended position, each leg having a pivot brace pivotally coupled thereto, each pivot brace having a free outer end pivotally coupled with a respective side tab of the central support portion;

a backrest portion pivotally coupled with the seat portion, the backrest portion including a pair of side supports, the side supports having lower ends pivotally coupled with the rearward tubular support of the horizontal support of the seat portion, one of the side supports having an aperture formed therein, the pair of side supports having a fabric back support secured therebetween, the fabric back support having an upper edge and a lower edge;

a pair of carrying straps coupled with respect to the backrest portion, the carrying straps each having an upper end secured to the upper edge of the fabric back support and a lower edge secured to the lower edge of the fabric back support in a spaced relationship; and a support tray removably coupled with the backrest portion, the support tray having a vertical support member extending downwardly therefrom, the support tray including a horizontal support member having a support collar extending upwardly therefrom, the support collar having an open upper end for rotatably receiving the vertical support member therein, the horizontal support member having an inner end removably received within the aperture of the side support of the backrest portion, the support tray including a cup holding block secured to the horizontal support member, the cup holding block having a cup receiving recess formed therein.

2. A compact transportable folding chair for allowing a person to easily carry a chair on their back to provide seating at a distant location comprising, in combination:

a seat portion comprised of a horizontal support, the horizontal support including a forward tubular support and a rearward tubular support in a spaced relationship, the horizontal support including a central support portion secured between the forward and rearward tubular supports, the central support portion having a padded cushion secured thereto, the central support portion having opposed side edges, the seat portion having opposed pairs of legs pivotally coupled thereto;

a backrest portion pivotally coupled with the seat portion;

a pair of carrying straps coupled with respect to the backrest portion; and a support tray removably coupled with the backrest portion.

3. The compact transportable folding chair as set forth in claim 2, wherein the opposed pairs of legs each include a front leg and a rear leg, the front legs having an upper end pivotally coupled with the forward tubular support, the rear legs having an upper end pivotally coupled with the rearward tubular support, the front legs and the rear legs each having a lower end for supporting the seat portion when in an extended position, each leg having a pivot brace pivotally coupled thereto, each pivot brace having a free outer end pivotally coupled with a respective side edge of the central support portion.

4. The compact transportable folding chair as set forth in claim 2, wherein the backrest portion includes a pair of side supports, the side supports having lower ends pivotally coupled with the rearward tubular support of the horizontal support of the seat portion, one of the side supports having an aperture formed therein, the pair of side supports having a fabric back support secured therebetween, the fabric back support having an upper edge and a lower edge.

5. The compact transportable folding chair as set forth in claim 4, wherein the carrying straps each have an upper end secured to the upper edge of the fabric back support and a lower edge secured to the lower edge of the fabric back support in a spaced relationship.

6. The compact transportable folding chair as set forth in claim 4, wherein the support tray has a vertical support member extending downwardly therefrom, the support tray including a horizontal support member having a support collar extending upwardly therefrom, the support collar having an open upper end for rotatably receiving the vertical support member therein, the horizontal support member having an inner end removably received within the aperture of the side support of the backrest portion.

7. The compact transportable folding chair as set forth in claim 6, wherein the support tray includes a cup holding block secured to the horizontal support member, the cup holding block having a cup receiving recess formed therein.

* * * * *